United States Patent [19]

Kovacs

[11] 4,357,653

[45] Nov. 2, 1982

[54] CHRISTMAS LIGHT FRAME

[76] Inventor: Michael J. Kovacs, 491 Saginaw Ave., Calumet City, Ill. 60409

[21] Appl. No.: 178,817

[22] Filed: Aug. 18, 1980

[51] Int. Cl.[3] ..... F21V 21/00

[52] U.S. Cl. ..... 362/388; 362/145; 362/147; 362/152; 362/250; 362/252; 362/285; 362/418; 362/430; 362/806

[58] Field of Search ..... 362/388, 147, 145, 152, 362/250, 252, 285, 418, 430, 806

[56] References Cited

U.S. PATENT DOCUMENTS 2,640,143 5/1953 Malone ..... 362/152

*Primary Examiner*—Stephen J. Lechert, Jr.

*Attorney, Agent, or Firm*—Charles W. Rummler

[57] ABSTRACT

An adjustable four sided frame assembled of four easily cut-to-length channeled members for displaying strands of Christmas light bulbs around rectangular window panes and having notched flanges running along opposite side of such member for the length of the same for engaging tinsel foil wrapping, and each member having slotted apertures in a longitudinal inner side flange for holding the light bulbs. The frame knocks down for storage.

3 Claims, 5 Drawing Figures

FIG. 1
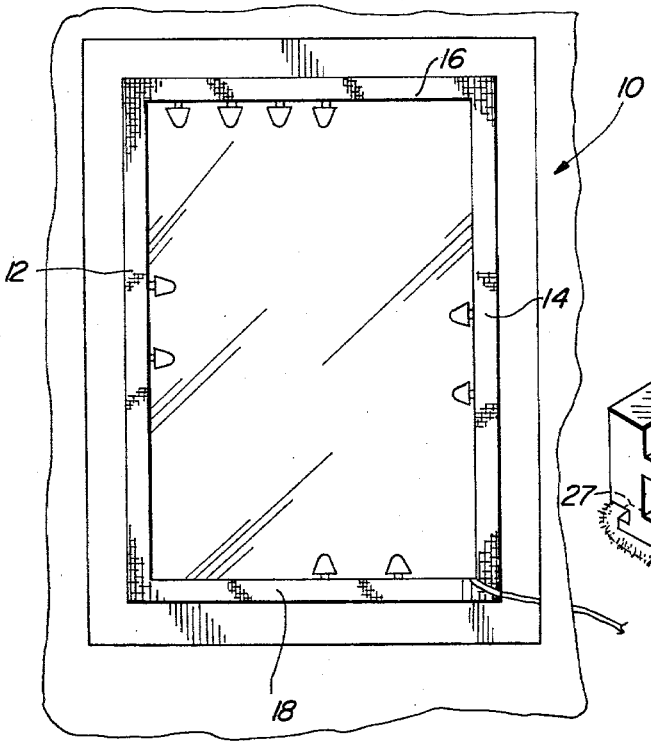
FIG. 4
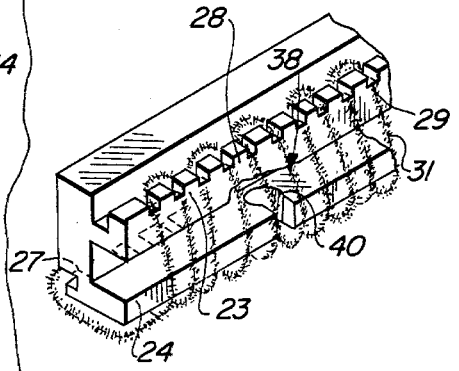
FIG. 2
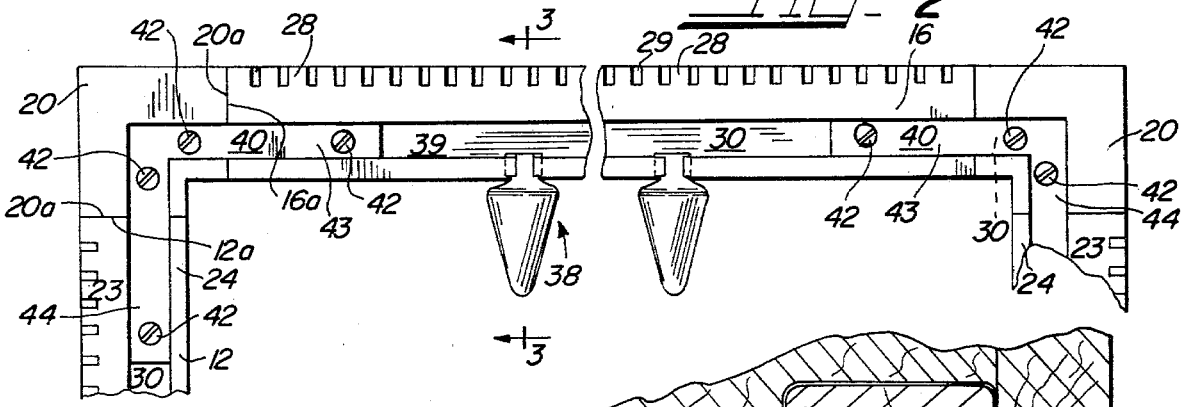
FIG. 3
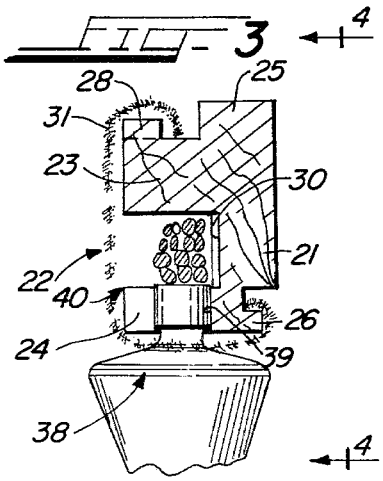
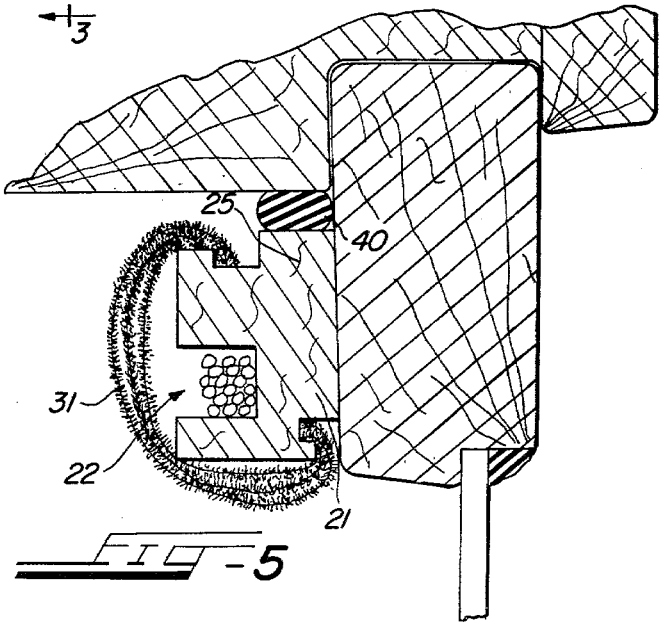
FIG. 5

CHRISTMAS LIGHT FRAME

BACKGROUND OF THE INVENTION

There is an established need for a knockdown readily assembled frame which can be made for insertion inserts in windows of any size for displaying standard strands of Christmas light bulbs around the opening of rectangular windows. Provision should be had for tinsel wrapping of the frame.

SUMMARY OF THE INVENTION

The gist of this invention lies in providing a rectangular frame comprised of easily cut-to-length extruded molded or shaped members, which, when cut off to appropiate lengths, can be made to fit any window. The members have channeled cross-sections which open inwardly of the window. The four corner members of the same cross-section as the side members but with short, squared-off legs, mate with the squared-off ends of the lengths of the adjoining side and top and bottom members of the frame. The channel of each section contains the running electrical wires of the Christmas light bulb strand. The legs of an angle bracket splice the side, top and bottom to each of the corner members at the four corners to complete the frame. The legs of the angles fasten along the webs of the side channels and the corner members across the juncture of the two where the squared-off ends meet. Notched flanges extend rearwardly off the forward flange at the inner leg portion of the frame channel and outwardly off the forward end of the outer flange of the frame for engaging strands of tinsel foil wrapped therearound. A plurality of apertures having access slots extending rearwardly from the forward edge of the inner flange of the channel are spaced along the length of the flange at regular intervals for holding bulb sockets to the frame. A thick outer extension of the web of the channel around the light bulb frame snugly seats in the molding around the frame of the window.

DESCRIPTION OF THE DRAWINGS

FIG. 1 shows a front view of the Christmas light bulb frame invention seated in the molding around a window frame;

FIG. 2 shows an enlarged fragmented inside view of the same;

FIG. 3 shows an enlarged cross-section of the light bulb frame taken along line 3—3 of FIG. 1;

FIG. 4 shows a perspective of a cut-off fragmentary end of the top frame member with tinsel wrapping; and FIG. 5 shows a greatly enlarged fragmented cross-sectional view of the same as installed on a conventional window frame.

THE PREFFERRED EMBODIMENT

Referring to FIG. 1, the Christmas light bulb display frame 10 installs in the molding around a rectangular window frame and comprises a squared-end left side frame member 12, a squared-end right side frame member 14 spaced from and parallel to the left side member 12, a squared-end top frame member 16 extending between the left side frame member 12 and the right side frame member 14 at the top of the frame and at right angles thereto, and a squared-end bottom frame member 18 across the bottom thereof in parallel relation to the top member 16. As shown in FIG. 2, a corner member 20, having squared leg ends **20*a* and at right angles and equally spaced from the corner intersection therebetween, inserts between the squared ends 12*a* and of member 12 on the left, and 16*a* and of member 16 at the top. Each of the other corners of the frame 10** is treated in a similar manner for assembling the frame.

Frame members 12, 14, 16 and 18 and corner members 20 each comprise a channel cross-section 22 having a web 21 which rests flat up against the window sash with an inwardly projecting outer flange 23 running the length of side, top and bottom members 12, 14, 16 and 18 and cornering at corner members 20. Flange 23 extends inwardly around the opening of the window frame, as shown in FIG. 5. An inner flange element 24 extending from the web 21, runs the length of side members 12 and 14, and top and bottom members 16 and 18, and corners at corner members 20 as shown in FIGS. 3 and 5, flange extension 26 extends outwardly from the inner base edge of a U-shaped recess formed in the outer face of the web 21 and like the flange 24 runs the length of members 12, 14, 16 and 18, and plurality of notches 27 (FIG. 4) is regularly space along flange extension 26. Also, a flange extension 28 extends outwardly from the edge of the flange 23, runs the length of members 12, 14, 16 and 18, and has a plurality of notches 29 likewise spaced therealong. Bottom 30 of channel 22 extends the full length of frame members 12, 14, 16 and 18 and mates up with similar bottoms in adjoining corner members 20 at the four corners of the frame 10. The outer end 25 of the web 21 runs the length of side, top and bottom members and 18 and corners with the corner members 20.

An angle bracket 40 of sheet metal has legs 43 and 44 which, as the side, top and bottom members 12, 14, 16 and 18 are assembled to the corner members 20, splice-connect the squared-off ends of said side, top and bottom members and 18 to said corner members by means of screws 42 as shown in FIG. 2.

As shown in FIG. 4, a plurality of notches 27 are spaced regularly along the outer flange 26, which extends the length of each of the frame members and, as shown in FIG. 2, a plurality of like notches 29 are formed in and spaced regularly along the extension 28 of flange 23 which runs the length of side, top and bottom frame members and the corner members 20 for engaging strands of tinsel foil 31 wrapped therearound.

As shown in FIGS. 2 and 3, a plurality of holders for the sockets of Christmas bulbs 38 have bores 39 through the channel flange 24 at regular spacing therealong for wired installation of a strand of commercially available Christmas lights, and, as shown in FIG. 5, an access slot 40 cut through the edge of flange 24 to the bores 39 allows for installation of the bulb socket in the holders 38.

For assembly of a strand of Christmas light bulbs in frame 10, as indicated in FIG. 2, the stem of each bulb slides sidewise into the frame members through the access slots 40 to allow seating the bulb socket in a respective holder 38. The strand of Christmas lights then assembles in the channel 22 of frame 10 by inserting the socket of each bulb through a slot 40 leading to a respective bulb holder 38 and then laying the strand of electrical wires connecting the bulbs in and along the channel 22.

Strands of tinsel are then wrapped around the frame and seated in notches 27 and 29 as shown in FIGS. 3, 4 and 5 to complete the Christmas light frame assembly. Frame 10 is then installed on the window sash, as shown in FIGS. 1 and 5, by insertion of the frame 10 snugly on the window frame molding, with a plurality of foam rubber grommets 40 spaced therearound, until the back face of the web 21 rests flat up against the face of the sash.

Although but one specific embodiment of this invention is herein shown and described, it will be understood that details of the construction shown may be altered or omitted without departing from the spirit of the invention as defined by the following claims.

I claim:

1. A frame for displaying strands of light bulbs and tinsel in rectangular configuration for window decoration comprising:

(a) side frame members of equal length in parallel and side-by-side relation;

(b) top and bottom frame members of equal length in parallel side-by-side relation and in over-and-under relation with said side members;

(c) four separate and identical corner members having means for fixed interchangeable connection with the respective ends of each of the adjoining side, top and bottom frame members;

(d) each of said side, and top and bottom frame members and each of the four corner members having channel-shaped cross sections, and the bottom leg of the channel in each frame member having longitudinally spaced bores for receiving and holding individual Christmas light sockets;

(e) and means on each frame member for engaging and holding a strand of tinsel wrapped spirally over the inner face of the frame member for the entire length thereof.

2. A frame for displaying strands of light bulbs and tinsel as defined in claim 1 wherein the means for holding the tinsel strand on each frame member comprises a longitudinally extending, outward projection on the upper leg of the frame member channel, and spaced notches formed along the length of the said projection.

3. A frame for displaying strands of light bulbs as defined by claim 2 wherein a U-shaped recess is provided in the outer face of each frame member and the bottom leg of said recess is provided with spaced notches along the length of the frame member.

* * * * *